United States Patent [19]

Breslow et al.

[11] 4,132,411

[45] Jan. 2, 1979

[54] GAME WITH CHANCE SHOT DICTATING PIECES

[75] Inventors: Jeffrey D. Breslow, Highland Park; Alan A. Hicks, Chicago, both of Ill.

[73] Assignee: Marvin Glass & Associates, Chicago, Ill.

[21] Appl. No.: 767,392

[22] Filed: Feb. 14, 1977

[51] Int. Cl.[2] ..... A63F 1/04; A63D 15/00

[52] U.S. Cl. ..... 273/119 R; 273/123 R; 273/129 GA; 273/298

[58] Field of Search ..... 273/3 A, 14, 118, 152.31, 273/119, 113, 115, 123 R, 124 R, 125 R

[56] References Cited

U.S. PATENT DOCUMENTS

| | | | |
|---|---|---|---|
| D 218,106 | 7/1970 | O'Leary | 273/3 A |
| 456,069 | 7/1891 | Snow | 273/123 R |
| 497,909 | 5/1893 | Davids | 273/119 R |
| 1,186,878 | 6/1916 | Brown | 273/119 R |
| 2,201,560 | 5/1940 | Nelson | 273/85 R |
| 2,611,615 | 9/1952 | Watson et al. | 273/85 R |
| 2,823,919 | 2/1958 | Scruggs | 273/152.31 |
| 3,877,699 | 4/1975 | Reiner | 273/119 R |
| 3,958,804 | 5/1976 | Godfrey | 273/123 R |

FOREIGN PATENT DOCUMENTS

| | | | |
|---|---|---|---|
| 559008 | 1/1944 | United Kingdom | 273/102 B |

*Primary Examiner*—Richard J. Johnson
*Assistant Examiner*—Lawrence E. Anderson
*Attorney, Agent, or Firm*—Mason, Kolehmainen, Rathburn & Wyss

[57] ABSTRACT

A pool-type game apparatus which includes a base structure having a playing surface over which play balls or the like may be propelled. Bumper rails substantially surround the playing surface and at least one ball receiving pocket is disposed at a playing position on the playing surface. A cue ball and a cue ball propelling device is provided for rolling the cue ball over the playing surface away from the ball propelling device into contact with other play balls or the rails. Position indicating indicia is provided on the playing surface for selective positioning of the play balls. A set of play cards are provided having indicating indicia thereon correlated to the position indicating indicia for dictating a particular shot of the cue ball from the propelling device in an attempt to strike other balls, rails, or the like, in order to propel a play ball into said pocket in accordance with the dictations of a particular play card.

13 Claims, 8 Drawing Figures

GAME WITH CHANCE SHOT DICTATING PIECES

BACKGROUND AND SUMMARY OF THE INVENTION

This invention relates to a pool-type game apparatus having a novel feature involving play cards dictating "shots" correlated to playing ball positions on a playing surface of the game apparatus.

Pool-type game apparatus have enjoyed popularity with children and adults for many years. As the game progresses, certain "shots" of varying difficulty are encountered during the play of the game. With the present invention, a pool table or playing surface is provided with playing positions indicated on the playing surface for positioning playing balls thereat. A cue ball is provided along with a cue ball propelling device for rolling the cue ball over the playing surface away from the ball propelling device into contact with the play balls or rail means surrounding the playing surface. Play cards are provided for dictating a particular shot correlated to the play ball positions on the playing surface so as to propel one or more of the play balls into one or more pockets in the playing surface. Some of the cards have "single shot" indicating means for propelling a single ball into a particular pocket, with award indicating means on the card should the player be successful in performing the dictated shot. Other cards have "trick" shots requiring the player to propel the cue ball off of the rail means or one or more of the play balls in order to propel one of the play balls into a particular pocket. Money cards are provided for awarding a player should the player successfully perform the "shot" as dictated by the play cards.

Other objects, features and advantages of the invention will be apparent from the following detailed description taken in connection with the accompanying drawings.

DETAILED DESCRIPTION OF THE PREFERRED EMBODIMENT

Figures 3, 4, 5, 6, 7, 8:
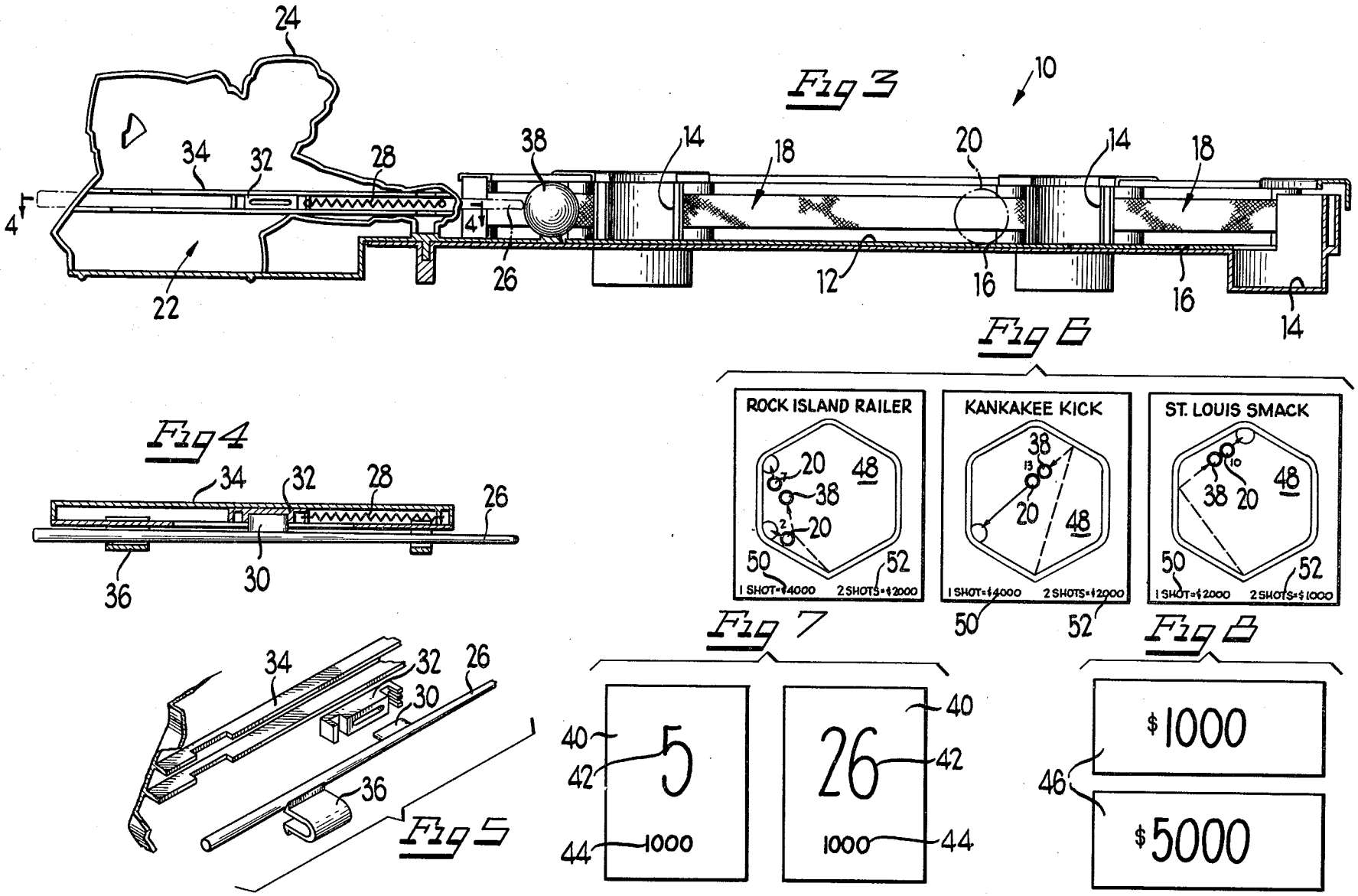
FIG. 3 is a vertical section taken generally along line 3—3 of FIG. 1.
FIG. 4 is a horizontal section taken generally along line 4—4 of FIG. 3.
FIG. 5 is a fragmented perspective view of the propelling device shown in FIGS. 1 and 3.
FIG. 6 is a plan view of several "trick shot" cards correlated to the game apparatus of the present invention.
FIG. 7 is a plan view of two "single shot" cards of the present invention.
FIG. 8 is a plan view of two "money" cards of the present invention.

Referring to the drawings in greater detail, the pool-type game apparatus of the present invention includes a base structure, generally designated 10, which defines a hexagonally shaped playing surface 12 having pockets 14 at the apexes of the hexagonal playing surface. As seen in FIG. 3, the pockets 14 extend downwardly from the playing surface 12 to define feet for supporting the game apparatus on a support surface such as a table, or the like. The playing surface 12 has position indicating means 16 which are numerically indicated for purposes described hereinafter.

Figures 1, 2:
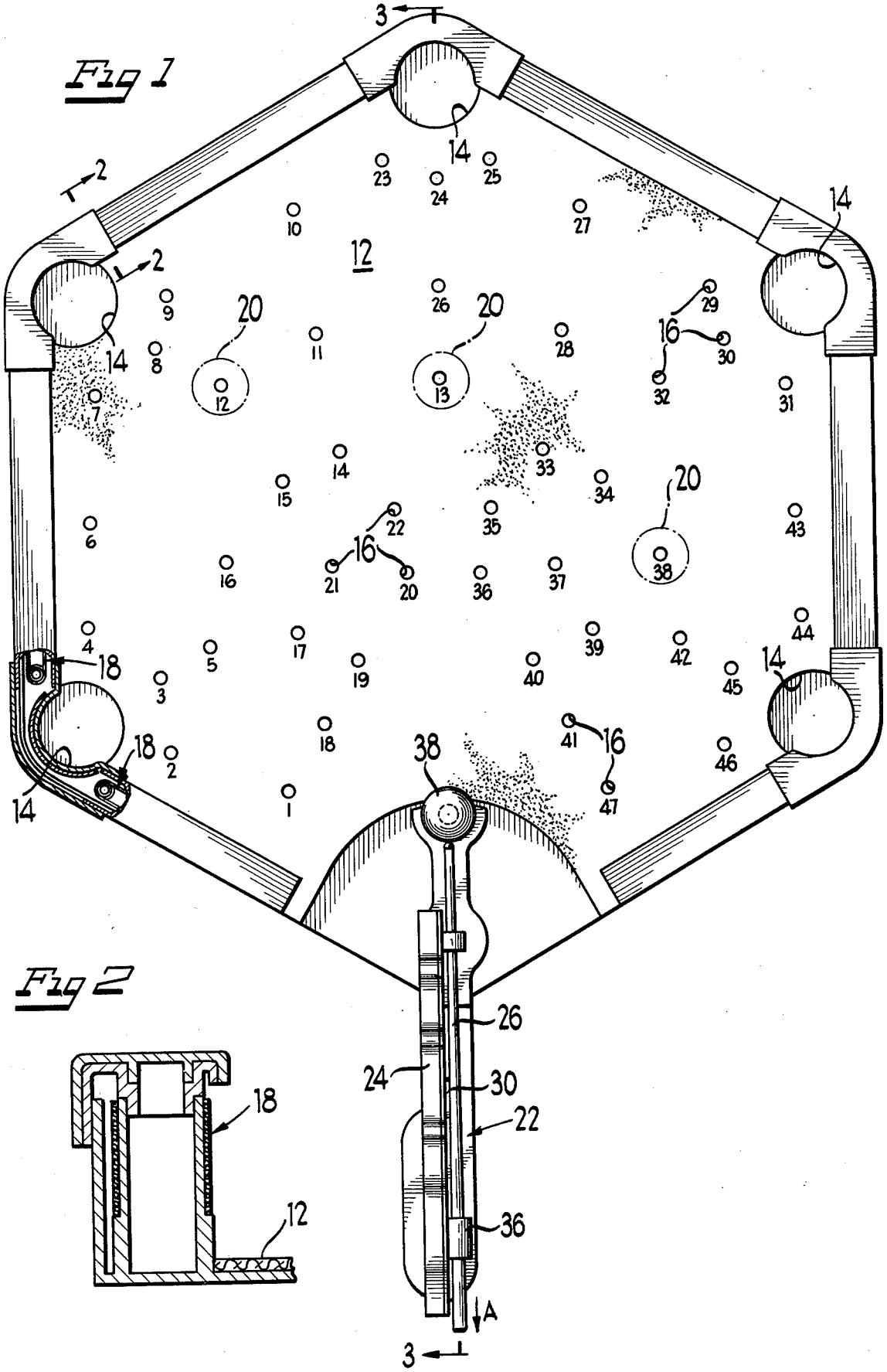
FIG. 1 is a partially fragmented top plan view of the game apparatus of the present invention.
FIG. 2 is a vertical section, on an enlarged scale, taken generally along line 2—2 of FIG. 1.

The playing surface 10 is surrounded by bumper rail means generally designated 18 (see FIG. 2), which span the gaps between the pockets 14.

One or more play balls 20 (FIGS. 1 and 3) are provided for positioning at the numerical position indicating means 16.

A propelling device, generally designated 22 (see FIGS. 1, 3, 4 and 5), is provided alongside of a simulated human pool player defined by a housing 24. The propelling device comprises a cue stick 26 which is spring loaded by a coil spring 28. The cue stick has a flange 30 (FIG. 5) which is positionable within a slide 32 which rides within a horizontally opening channel-shaped guide 34. The cue stick 26 also has a U-shaped guide 36 for maintaining horizontal directional movement with the channel 34.

A cue ball 38 is provided for striking by the cue stick 26 when the cue stick is cocked in the direction of arrow A (FIG. 1) and released so that the forward end of the cue stick 26 strikes the cue ball 38 so as to ricochet off of one or more play balls 20 or the bumper rails 18 in accordance with the dictates of play cards described hereinafter.

More particularly, referring to FIG. 7, certain play cards 40 are provided with indicating means 42 thereon which are correlated to one of the positions 16 on the playing surface. In addition, each play card 40 includes indicating means 44 thereon for rewarding a player should he successfully make the "shot" as dictated by the cards 40. The cards 40 are "single shot" cards and dictate that a player must shoot the cue ball 38 against a ball placed at one of the positions 16 (such as the position "26" as indicated on the righthand card shown in FIG. 7) and if the player successfully propels the ball at that position into a pocket he will be rewarded money as indicated at 44 on the particular "single shot" card by means of money cards 46 (FIG. 8).

In addition, referring to FIG. 6, "trick cards" are provided which have indicating means thereon correlated to the position 16 on the playing surface 12 to dictate that a player must shoot the cue ball 38 and ricochet off of one or more of the play balls 20 or the rail means 18 and propel a particular ball placed at one of the positions 16 in a selected pocket 14 about the playing surface 12. Each "trick card" 48 also has indicating means 50 and 52 which award a successful player by completing the dictated shot on a first try, indicating means 50, or a second shot, indicating means 52. Should a player be successful on either shot, he will be awarded the indicated monetary amount by means of the money cards 46.

In order to terminate the game, various schemes can be devised as by setting a maximum amount of money collected by a particular player by successfully completing shots dictated by the "single shot" cards 40 or the "trick shot" cards 48 during the play of the game.

With the correlated combination of the present invention including the structure of the playing surface 12, propelling device 22, cue ball 38 and one or more play balls 20 in combination with the structurally correlated play cards 40 and 48, various alternative schemes of play are contemplated by the present invention.

The foregoing detailed description has been given for clearness of understanding only and no unnecessary limitations should be understood therefrom as some modifications will be obvious to those skilled in the art.

We claim:

1. A game apparatus, comprising:
means defining a playing surface;
a plurality of rollable playing pieces;
target means for receiving said rollable playing pieces defined on said playing surface;
propulsion means for propelling one of said playing pieces onto said playing surface for travel thereacross;
a plurality of locating means on said playing surface for selectively positioning at least one of said playing pieces; and
chance means including a plurality of chance playing pieces having various indicia means for dictating various playing piece movements, each chance playing piece having a single indicia means for indicating at least one locating means for positioning at least one of said rollable playing pieces and for identifying only one path of travel for a first rollable playing piece from the propulsion means into engagement with a second rollable playing on one of said locating means and a different path of for said second rollable playing piece over said playing surface after engagement by said first rollable playing piece.

2. The game apparatus of claim 1 wherein said propulsion means is pivotally mounted to the playing surface so as to be capable of being aimed to propel a playing piece in any direction over the playing surface.

3. The game apparatus of claim 1 wherein said chance playing pieces also include means for indicating an award upon the travel of said playing pieces along the paths of travel defined by said chance playing piece.

4. The game apparatus of claim 1 wherein said different path of travel for said second rollable playing piece defined by said chance playing piece is toward said target means.

5. The game apparatus of claim 4 wherein said target means defines a plurality of playing piece receiving pockets defined in the playing surface.

6. A pool type game apparatus, comprising, in combination:
a base structure having a playing surface over which balls or the like may be propelled, a bumper rail means substantially surrounding the playing surface, at least one ball receiving pocket disposed at a playing position on the playing surface, a cue ball, a cue ball propelling device for rolling the cue ball over said playing surface away from the ball propelling device into contact with the balls or the rail means, position indicating means on said playing surface for selective positioning of said play balls, and a set of cards having various indicia means for dictating various shots, each card having a single indicia means thereon correlated to said position indicating means for independently prescribing the position indicating means to be occupied by a ball and only one path of travel of the cue ball from said propelling device into engagement with the one or more balls on said prescribed positions, in order to propel said balls into pockets along said one path prescribed by said card.

7. The game apparatus of claim 6 including a plurality of pockets on said playing surface for multiplying the variety of shots to be dictated by said play cards.

8. The game apparatus of claim 7 wherein said playing surface is polygonal and has apexes at which said pockets are located.

9. The game apparatus of claim 6 wherein said propelling device is fixedly and pivotally movably mounted at one side of said playing surface so as to be capable of being aimed to propel said cue ball in any direction over said playing surface.

10. The game apparatus of claim 6 wherein said cards have indicating means thereon to provide a predetermined award to a player for successfully making said shot on a first attempt and providing a lesser award for making said shot on a subsequent attempt.

11. The game apparatus of claim 6 wherein said set of cards includes cards having indicating means thereon for dictating "trick" shots for ricocheting said cue ball or said play balls off of each other or said rail means in order to propel one or more play balls into certain dictated pockets on the playing surface on a first attempt.

12. The game apparatus of claim 11 wherein said "trick" cards have indicating means thereon for awarding a player in the event that the player successfully performs the "trick" dictated by the "trick" cards.

13. The game apparatus of claim 6 including "money" cards for awarding a player in the event that the player performs the dictation of said play cards.

* * * * *